US010925783B2

(12) United States Patent
Epstein

(10) Patent No.: US 10,925,783 B2
(45) Date of Patent: Feb. 23, 2021

(54) CONJUGAL AID CHAIR

(71) Applicant: Randy Epstein, San Diego, CA (US)

(72) Inventor: Randy Epstein, Chula Vista, CA (US)

( * ) Notice: Subject to any disclaimer, the term of this patent is extended or adjusted under 35 U.S.C. 154(b) by 206 days.

(21) Appl. No.: 15/293,209

(22) Filed: Oct. 13, 2016

(65) Prior Publication Data

US 2017/0105892 A1 Apr. 20, 2017

Related U.S. Application Data

(60) Provisional application No. 62/242,005, filed on Oct. 15, 2015.

(51) Int. Cl.

| | |
|---|---|
| ***A61G 5/08*** | (2006.01) |
| ***A61H 19/00*** | (2006.01) |
| ***A47C 15/00*** | (2006.01) |

(52) U.S. Cl.

CPC ..... *A61G 5/0833* (2016.11); *A47C 15/008* (2013.01); *A61G 5/0891* (2016.11); *A61H 19/50* (2013.01); *A61H 2201/0149* (2013.01); *A61H 2201/0161* (2013.01); *A61H 2201/0192* (2013.01); *A61H 2201/164* (2013.01); *A61H 2201/1635* (2013.01)

(58) Field of Classification Search

CPC ..... A61G 5/0883; A61G 5/08; A61G 5/0891; A61G 5/125; A61G 5/127; A61G 5/128; A61G 13/0009; A61G 15/005; A61G 13/123; A61G 7/0755; A61G 13/0081; A61G 15/007; A61G 15/02; A61G 15/08; A61G 15/002; A61G 7/0507; A61G 5/0833; A47C 4/30; A47C 4/44; A47C 4/46; A47C 7/503; A47C 7/506; A47C 13/00; A47C 13/005; A47C 15/004; A47C 15/005; A47C 15/008; A61H 19/50; A61H 2201/1635; A61H 2201/1638; A61H 2201/164; A61H 2201/1642; A61H 2201/0149; A61H 23/02

USPC ..... 297/39, 46, 183.2, 325, 423.12, 440.11; 128/845

See application file for complete search history.

(56) References Cited

U.S. PATENT DOCUMENTS 2,722,972 A * 11/1955 Altruda ..... A47C 4/286 248/164
3,061,365 A * 10/1962 Frieberg ..... A61G 5/08 297/183.6

(Continued)

FOREIGN PATENT DOCUMENTS

| | | |
|---|---|---|
| CN | 201426532 Y | 3/2010 |
| EP | 0136884 A2 | 4/1985 |

*Primary Examiner* — Ophelia A Hawthorne
(74) *Attorney, Agent, or Firm* — TJSL Patent Clinic

(57) ABSTRACT

A conjugal aid chair includes a seat and back frame, which are attached to the front and the back leg frames via first and second pivot plates. Both the seat and back frames have connection snaps, allowing a mesh body support sling to be attached via its connection snaps. A pair of collapsible handles is attached to both the seat and back frames for user support. The two arms of the conjugal aid chair have removable appendage bolsters, allowing the sitting user to change their position to desired comfort. The angle of the front leg frame can be adjusted using the slideable push-button adjusters. An interchangeable cover-sleeve is slipped over the mesh body support sling before the mesh body support sling is attached to the back and seat frames.

14 Claims, 12 Drawing Sheets

(56) References Cited

U.S. PATENT DOCUMENTS

| | | | | | |
|---|---|---|---|---|---|
| 3,695,702 | A * | 10/1972 | Ingellis | A47C 4/02 | 297/440.11 |
| 3,971,592 | A | 7/1976 | Farley | | |
| 5,389,062 | A * | 2/1995 | Mitchum, Jr. | A47C 15/008 | 5/929 |
| 5,453,080 | A | 9/1995 | Mitchum, Jr. | | |
| 5,538,011 | A | 7/1996 | Craft | | |
| 5,735,570 | A * | 4/1998 | Tseng | A47C 4/20 | 297/35 |
| 5,875,779 | A | 3/1999 | Furman et al. | | |
| 6,056,353 | A * | 5/2000 | Meara | A61G 5/08 | 297/344.18 |
| 6,257,660 | B1 * | 7/2001 | Calvey | A47C 3/029 | 297/16.1 |
| 6,640,808 | B1 | 11/2003 | Fessler | | |
| 6,698,431 | B1 | 3/2004 | Harris | | |
| 6,745,774 | B2 | 6/2004 | Fessler | | |
| 2003/0111876 | A1 * | 6/2003 | Black | A47C 15/008 | 297/179 |
| 2003/0164626 | A1 * | 9/2003 | Lardieri | A47O 7/546 | 297/35 |
| 2008/0179933 | A1 * | 7/2008 | Puccio | A47C 1/026 | 297/411.3 |
| 2016/0067129 | A1 * | 3/2016 | Russell | A61G 13/124 | 128/845 |

* cited by examiner

CONJUGAL AID CHAIR

CROSS-REFERENCE TO RELATED APPLICATION

The present application claims the benefit of U.S. Provisional Patent Application No. 62/242,005, filed on Oct. 15, 2015, entitled "Conjugal aid chair", the entire disclosure of which is incorporated by reference herein.

FIELD OF THE DISCLOSURE

This disclosure relates to sexual relations aids, and in particular to a portable, self-supporting, multi-adjustable, lounge chair to aid in sexual relations.

BACKGROUND

The advantages of sexual relations have been long recognized by medical authorities, and include, but are not limited to, strengthening of the immune system, lowering blood pressure, and strengthening the circulatory system which reduces the risk for heart attacks. Standard home furniture (with the exception of beds) is not specifically designed to be used for intercourse. This creates a problem because the variety of furniture which may be used during conjugal relations is limited. This echoes even more true where one partner's ability to move is limited due to medical reasons. In the latter case, proper furniture is not available to be used by individuals suffering from medical conditions which render it difficult or impossible to engage in sexual relations in conventional ways. Moreover, the ability to store furniture in a discrete location when house guests visit has been challenging due to previous designs and their overall weight.

A number of patents have issued for chairs, seats, or tables to be used in aiding sexual intercourse. For example, U.S. Pat. No. 5,538,011 provides a seat for the handicapped individual to sit on and a pair of leg supports. The device, however, does not provide a means for adjusting the height of the leg supports or the angle of the front frame. Additionally, the device does not provide a means for the non-disabled partner to support himself/herself during conjugal relations such as with handles. Moreover, the disclosure does not teach the possibility of a detachable support sling thereby rendering lifting and storage difficult.

The apparatus in U.S. Pat. No. 6,698,431 does not provide an easy and discrete way to store the apparatus due to its overall size and lack of folding ability. Furthermore, the size and location of apparatus's handlebars give the users only one general area to support themselves—behind the user who is in a sitting position, while using the apparatus. This limitation not only makes the apparatus less functional, it can be potentially dangerous given the various acts performed on the chair require moving and balancing. Therefore, users need multiple handlebars to ensure each act is performed safely.

Finally, U.S. Pat. No. 3,971,592 provides a conjugal chair that is capable of folding, but it can only be adjusted to two positions—"horizontal" and "vertical." Furthermore, the device does not include important features such as multiple handles for support, appendage bolsters that allow the user to change his/her angle, and angle adjusters that allow the non-sitting user to adjust the angle of his/her sitting partner. In addition, the chair does not provide an interchangeable cover-sleeve, which allows the users to have an option as to the material one lays on. Thus, there is a need for an apparatus capable of assisting persons with physical disabilities, and are unable to safely perform sexual intercourse, intimacy, and foreplay because of aforementioned limitations regarding balancing, comfort, and angle adjustments. Moreover, the ability to store easily/discretely is likely to increase in the frequency of aforementioned activities.

SUMMARY OF THE INVENTION

The present invention, in its many embodiments, provides an apparatus for aiding sexual intercourse for assisting people with physical disabilities. Accordingly, it is an object of the present invention to provide a conjugal aid chair having appendage bolsters and front legs that are capable of height adjustment.

In an exemplary embodiment, the conjugal aid chair apparatus comprises a seat frame comprising a first set of male connection snaps, a first pivot plate and a second pivot plate, wherein the seat frame connects to the second pivot plate; a back frame comprising a second set of male connection snaps, wherein the back frame is connected to the second pivot plate; a front leg frame connected to the first pivot plate; a back leg frame connected to the first pivot plate and the second pivot plate, wherein the back leg frame is configured to allow the second pivot plate to connect to the back frame and the seat frame; two arms connected to the back frame and the first pivot plate; and wherein the two arms comprise a plurality of appendage bolsters; and wherein the two arms are configured to allow the first pivot plate to connect to the back leg frame and the front leg frame; a mesh body support sling comprising multiple sets of female connection snaps. This exemplary embodiment provides enhanced ease and versatility of use including, but not limited to, the ability to fold and store in a discrete location; safely perform sexual intercourse, intimacy, and foreplay because of the embodiments dual body support handles; and the ability to adjust the body position angles for added comfort and pleasure.

In another exemplary embodiment, the first set of male connection snaps are located on the front side of the seat frame. This exemplary embodiment provides easy attachment and removal of the mesh body support sling to the seat frame.

In yet another exemplary embodiment, the second set of male connection snaps are located on the top side of said back frame. This exemplary embodiment provides easy attachment and removal of the mesh body support sling to the back frame.

In still another exemplary embodiment, the conjugal aid chair comprises a back frame that further comprises a first handle pair. This exemplary embodiment provides increased body-support.

In another exemplary embodiment, the conjugal aid chair comprises a first handle pair that is collapsible. This exemplary embodiment provides ease of storage and simple reassembly.

In one exemplary embodiment, the conjugal aid chair comprises a first pivot plate that further comprises a second handle pair. This exemplary embodiment provides increased body-support.

In a further exemplary embodiment, the conjugal aid chair comprises a second handle pair that is collapsible. This exemplary embodiment provides ease of storage and simple reassembly.

In still another exemplary embodiment, the conjugal aid chair comprises a plurality of appendage bolsters that are adjustable from about 0 to 4 inches in height. This exemplary embodiment provides increased comfort during use and increased range of angles for the user to enjoy.

In one exemplary embodiment, the conjugal aid chair comprises a front leg frame that is adjustable from 0 to about 7.50 inches in height. This exemplary embodiment provides increased comfort during use and increased range of angles for the user to enjoy.

In a further exemplary embodiment, the conjugal aid chair comprises a mesh body support sling comprising multiple sets of female connection snaps on the top end of the mesh body support sling and on the bottom end of the mesh body support sling. This exemplary embodiment provides easy attachment and removal of the mesh body support sling to the back frame and the seat frame.

In yet another exemplary embodiment, the conjugal aid chair comprises a mesh body support sling that comprises an interchangeable cover-sleeve. This exemplary embodiment provides the ability to substitute the cover-sleeves materials for the user's comfort, to wash the cover-sleeve after use, and to substitute the cover-sleeves colors for aesthetic purposes.

BRIEF DESCRIPTION OF THE DRAWINGS

Exemplary embodiments of the present invention will now be described, by way of example only, with reference to the accompanying figures.

DETAILED DESCRIPTION OF THE INVENTION

Figure 1:
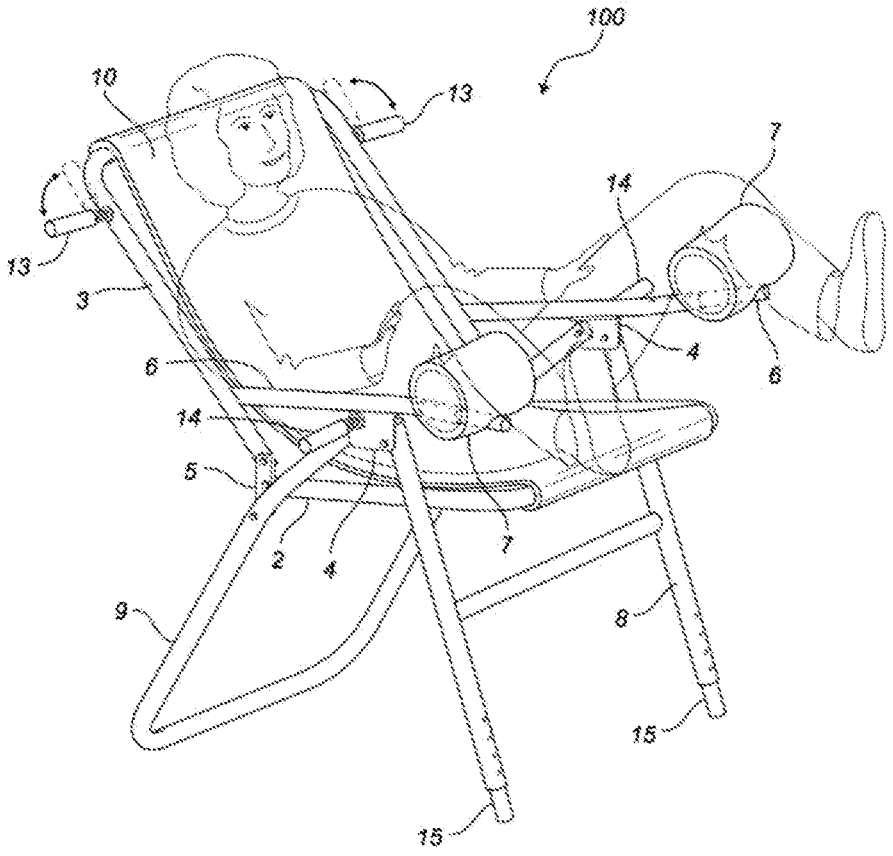
FIG. 1 is an exemplary embodiment of a perspective side view of a conjugal aid chair, according to one aspect of the current disclosure.

The following detailed description is merely exemplary in nature and is not intended to limit the disclosure or the application and uses of the invention.

As used herein, the word "exemplary" means "serving as an example, instance, or illustration." Thus, any embodiment described herein as "exemplary" is not necessarily to be construed as preferred or advantageous over other embodiments. Furthermore, there is no intention to be bound by any expressed or implied theory presented in the preceding technical field, background, brief summary, or the following detailed description.

In this description, reference is made to the drawings, wherein like parts are designated with like reference numerals throughout. As used in the description herein and throughout, the meaning of "a," "an," and "the" includes plural reference unless the context clearly dictates otherwise.

As used herein, the term "about" in conjunction with a numeral refers to a range of that numeral starting from 10% below the absolute of the numeral to 10% above the absolute of the numeral, inclusive.

The present invention, in one embodiment, is a conjugal aid chair apparatus which comprises a seat frame comprising a first set of male connection snaps on the seat frame; a back frame comprising a second set of male connection snaps on the back frame, wherein the back frame is connected to a first pivot plate and a second pivot plate; two arms comprising the first and second pivot plates, wherein the two arms further comprise a plurality of appendage bolsters, and wherein the two arms are connected to the back frame; a front leg frame connected to the first pivot plate; a back leg frame connected to the first pivot plate and the seat frame; and a mesh body support sling comprising multiple sets of female connection snaps. This embodiment of the invention provides enhanced ease and versatility of use including, but not limited to, the ability to fold and store the chair in a discrete location; safely perform sexual intercourse, intimacy, and foreplay because of the embodiments dual body support handles; and the ability to adjust the body position angles for added comfort and pleasure.

Referring now to the drawings, an exemplary configuration is schematically depicted in FIGS. 1-14, in which a conjugal aid chair 100 is designed to support a human body during an intimate activity. In one exemplary embodiment, conjugal aid chair 100 comprises a seat frame 2 comprising a first set of male connection snaps 11*a* on seat frame 2; back frame 3 comprising a second set of male connection snaps 11*b* on back frame 3; two arms 6 comprising first pivot plate 4 and second pivot plate 5, wherein two arms 6 further comprise a plurality of appendage bolsters 7; front leg frame 8; back leg frame 9; and mesh body support sling 10 comprising multiple sets of female connection snaps 12.

In an embodiment as shown in FIG. 1, seat frame 2 is rotatably attached to second pivot plate 5, and second pivot plate 5 is also rotatably attached to back leg frame 9. In an exemplary embodiment, second pivot plate 5 is rotatably attached to back frame 3 and also to back leg frame 9. In yet another exemplary embodiment, mesh body support sling 10 is attached to seat frame 2 and back frame 3 via a second set of male connection snaps 11*b* and multiple sets of female connection snaps 12.

In one embodiment, two arms 6, front leg frame 8, and back leg frame 9 are all rotatably attached to first pivot plate 4. In yet another exemplary embodiment, plurality of appendage bolsters 7 are attached to two arms 6 by inserting a push-button into appendage bolsters 7 completely through a plurality of adjustment holes 18 on two arms 6 until plurality of appendage bolsters 7 are flush with two arms 6.

In yet another embodiment, front leg frame 8 is rotatably attached to seat frame 2 and first pivot plate 4, and first handle pair 13 is attached to back frame 3. In one embodiment, second handle pair 14 is attached to first pivot plate 4. In another embodiment, first angle adjuster 15 is attached to front leg frame 8 via a push-button (not shown). In a further embodiment, first handle pair 13 and second handle pair 14 provide support for one of the partners from multiple angles during intimate activities.

Figure 2:
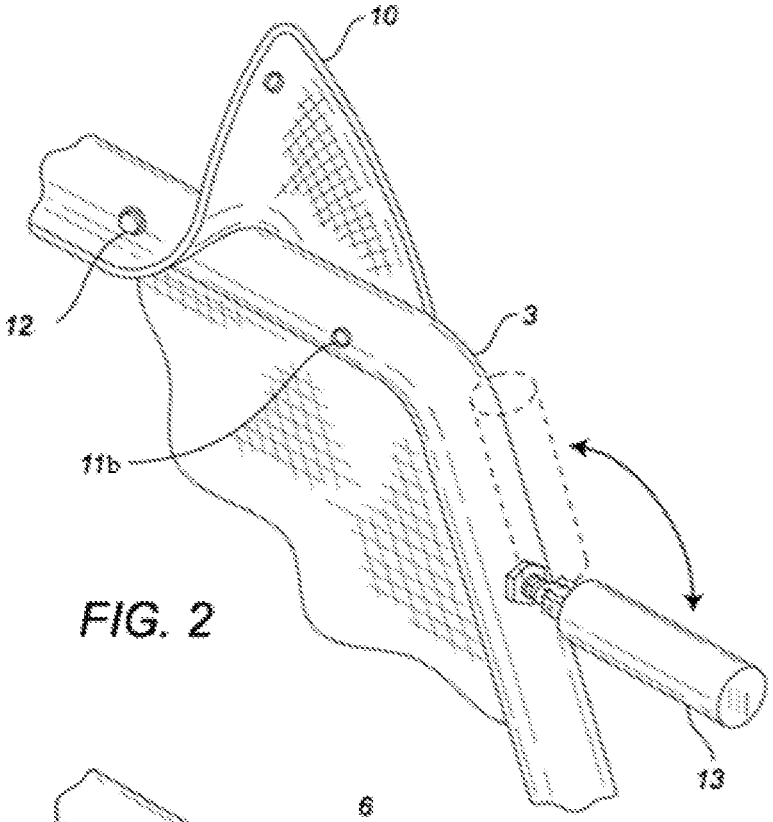
FIG. 2 is an exemplary embodiment of a partial perspective view of a back frame and a mesh body support sling.
Figure 13:
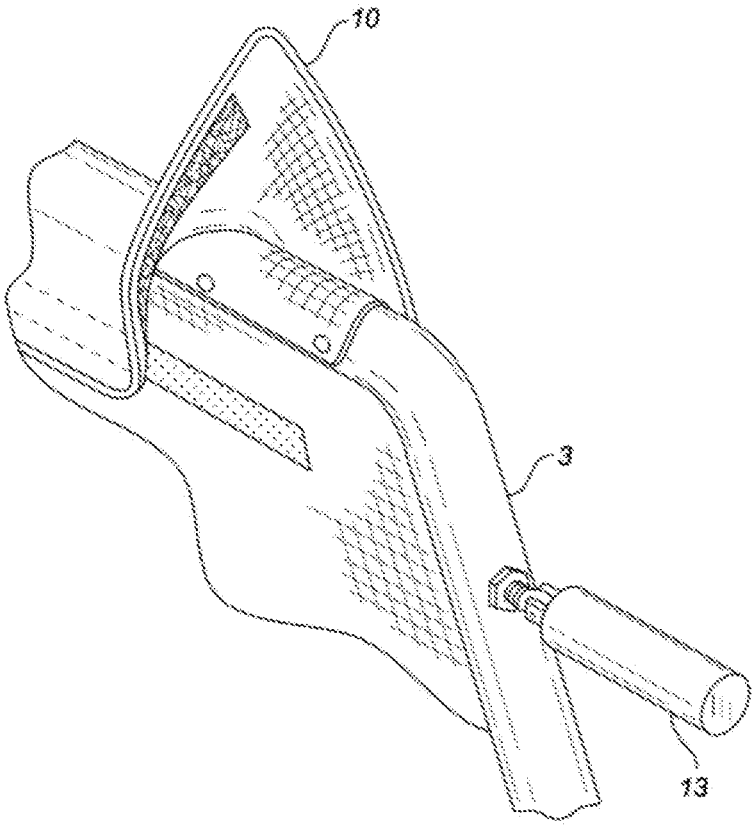
FIG. 13 is another exemplary embodiment of a partial perspective view of a back frame and a mesh body support sling.
Figure 14:
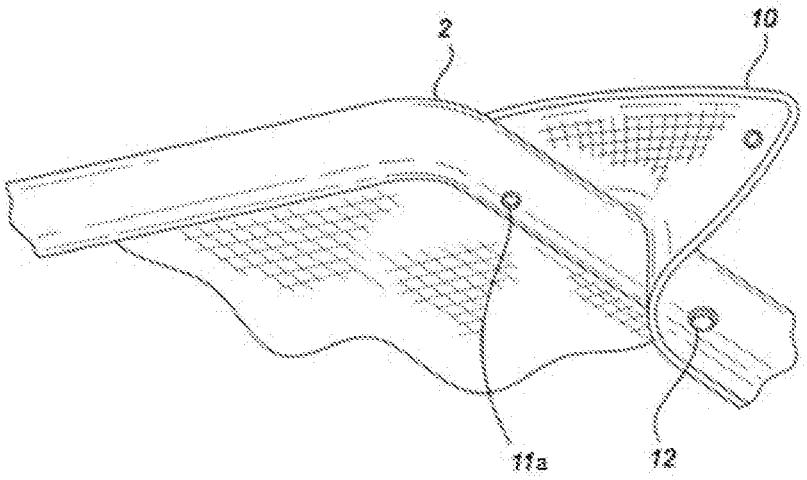
FIG. 14 is an exemplary embodiment of the connection snaps on the sling and seat frame.

Referring now to FIG. 2, FIG. 13, and FIG. 14, in one embodiment mesh body support sling 10 is shown partly attached to back frame 3 with second set of male connection snaps 11*b* connected to multiple sets of female connection snaps 12. In another embodiment, first handle pair 13 is attached to back frame 3.

Figure 3:
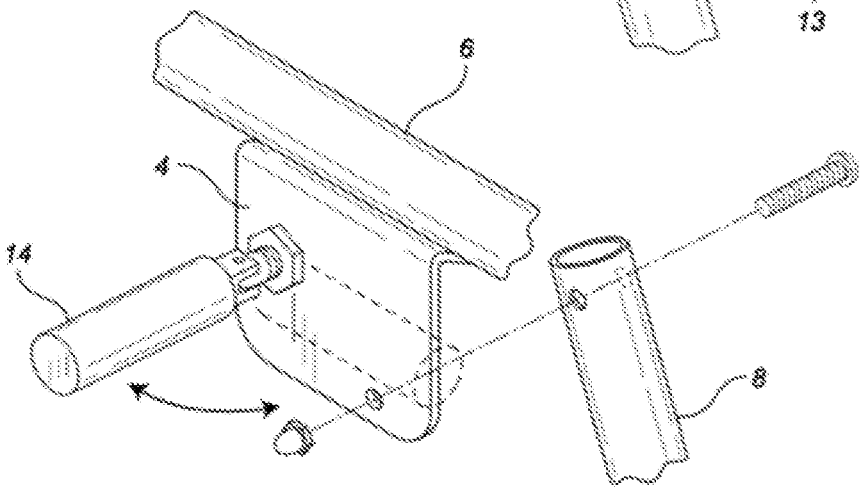
FIG. 3 is an exemplary embodiment of a perspective view of a first pivot plate and a second handle pair attached.

FIG. 3 depicts an exemplary embodiment of a side isometric view portion of two arms 6 and front leg frame 8, which are both connected to first pivot plate 4. In one embodiment, second handle pair 14 is able to rotate from its attachment point on first pivot plate 4.

Figure 4:
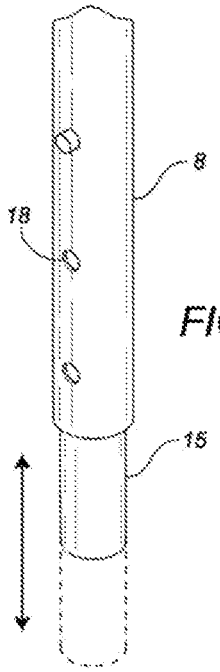
FIG. 4 is an exemplary embodiment of a perspective view of a front leg frame and first angle adjusters.

FIG. 4 shows a perspective view of a partial embodiment of conjugal aid chair 100 comprising front leg frame 8 and first angle adjuster 15. In this embodiment, first angle adjuster 15 slideably moves within front leg frame 8, so that the angle of conjugal aid chair 100 may be adjusted to a greater or lesser value, depending on the relative position of first angle adjuster 15 within front leg frame 8. In an exemplary embodiment, front leg frame 8 includes a plurality of adjustment holes 18 for receiving a push-button to releasably lock the desired position of the first angle adjuster 15 within front leg frame 8. In another exemplary embodiment, a user may easily adjust conjugal aid chair 100 angles by pressing the push-button and sliding first angle adjuster 15 to the most convenient position for the users and allowing the push-button to re-engage in the selected plurality of adjustment holes 18. In one embodiment, the push-button includes a spring (not shown) or other tensioning means that maintains tension of the adjustment pin within the desired plurality of adjustment holes 18 so the adjustment pin does not easily slip from the engaged position in the plurality of adjustment holes 18 and securely maintains the desired conjugal aid chair 100 angle.

As shown in FIG. 4, first angle adjuster 15 may slide in an upward or downward direction within front leg frame 8, and one of skill in the art will readily understand that the length of front leg frame 8 is varied by the amount of upward or downward adjustment of the length of first angle adjuster 15 within front leg frame 8. In still another embodiment, pair of front leg frames 8 comprising pair of first angle adjuster 15 slideably attached within each front leg frame 8, thus, providing a greater degree of customization as to a comfortable and convenient position of conjugal aid chair 100 angles.

Figure 5:
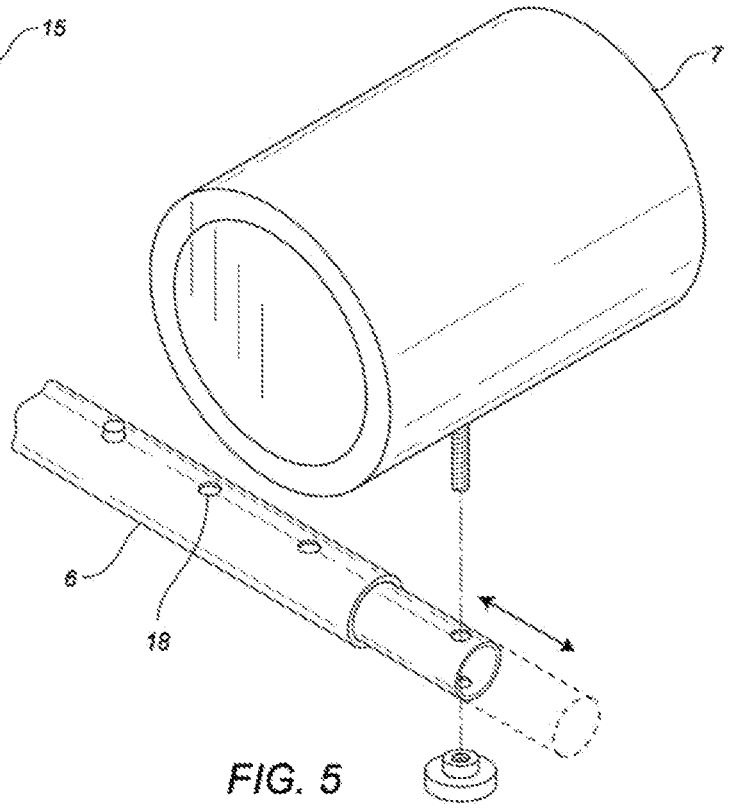
FIG. 5 is an exemplary embodiment of a perspective view of an arm with appendage bolsters.

FIG. 5 is one embodiment of a perspective view of end portion of two arms 6, wherein plurality of appendage bolsters 7 attaches by inserting push-button of plurality of appendage bolsters 7 through plurality of adjustment holes 18 on end portion of two arms 6 to ensure plurality of appendage bolsters 7 are secured and ready for use.

Figure 6A:
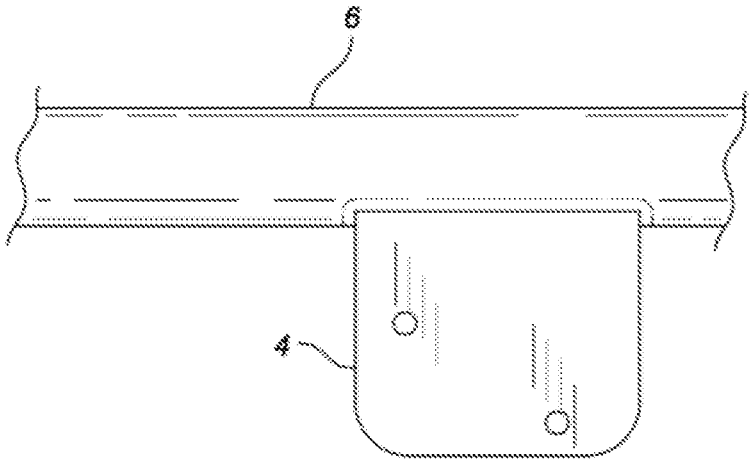
FIG. 6A is an exemplary embodiment of a perspective view of first pivot plate before and after the appropriate bends.

FIG. 6A shows one embodiment of a perspective view of first pivot plate 4. In this embodiment, two arms 6 attach to first pivot plate 4 via a weld.

Figure 6B:
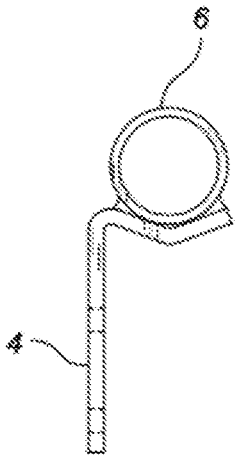
FIG. 6B is an exemplary embodiment of a cross-section view of first pivot plate before and after the appropriate bends.

FIG. 6B shows one embodiment of a cross-section view of first pivot plate 4 as it attaches to two arms 6 via a welded seem.

Figure 7A:
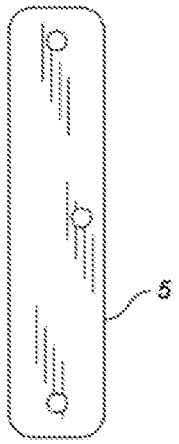
FIG. 7A is an exemplary embodiment of a perspective view of a second pivot plate.

FIG. 7A shows one embodiment of a perspective view of second pivot plate 5 separate from other interacting elements.

Figure 7B:
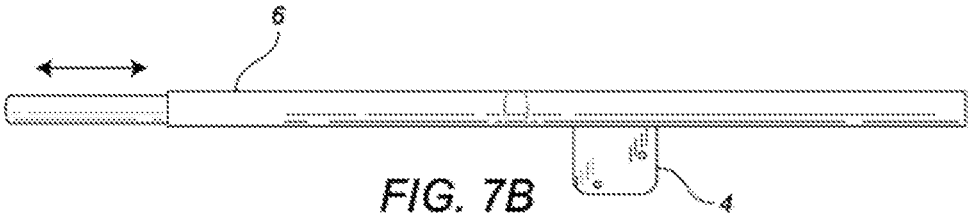
FIG. 7B is an exemplary embodiment of a perspective view of a first pivot plate before and after the appropriate bends.

FIG. 7B shows one embodiment of a perspective view of first pivot plate 4 before the appropriate bends and the slideable motion of the second angle adjuster (not shown) 15 in two arms 6. In this embodiment, two arms 6 attach to first pivot plate 4 via a weld which is seen from the front of two arms 6.

Figure 7C:
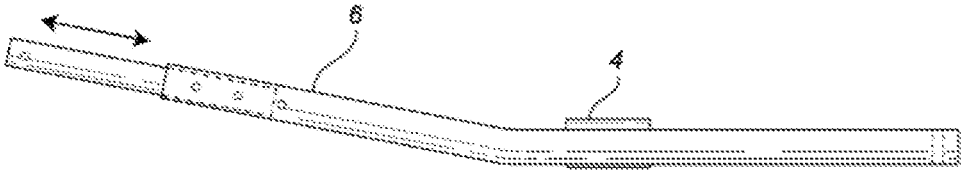
FIG. 7C is an exemplary embodiment of a perspective view of angle adjustment's ability to collapse into an arm.

FIG. 7C shows one embodiment of a perspective view of first pivot plate 4 after the appropriate bends and the slideable motion of the second angle adjuster (not shown) 15 in two arms 6. In this embodiment, two arms 6 attaches to first pivot plate 4 via a weld (not shown), which is seen from behind two arms 6.

Figure 8:
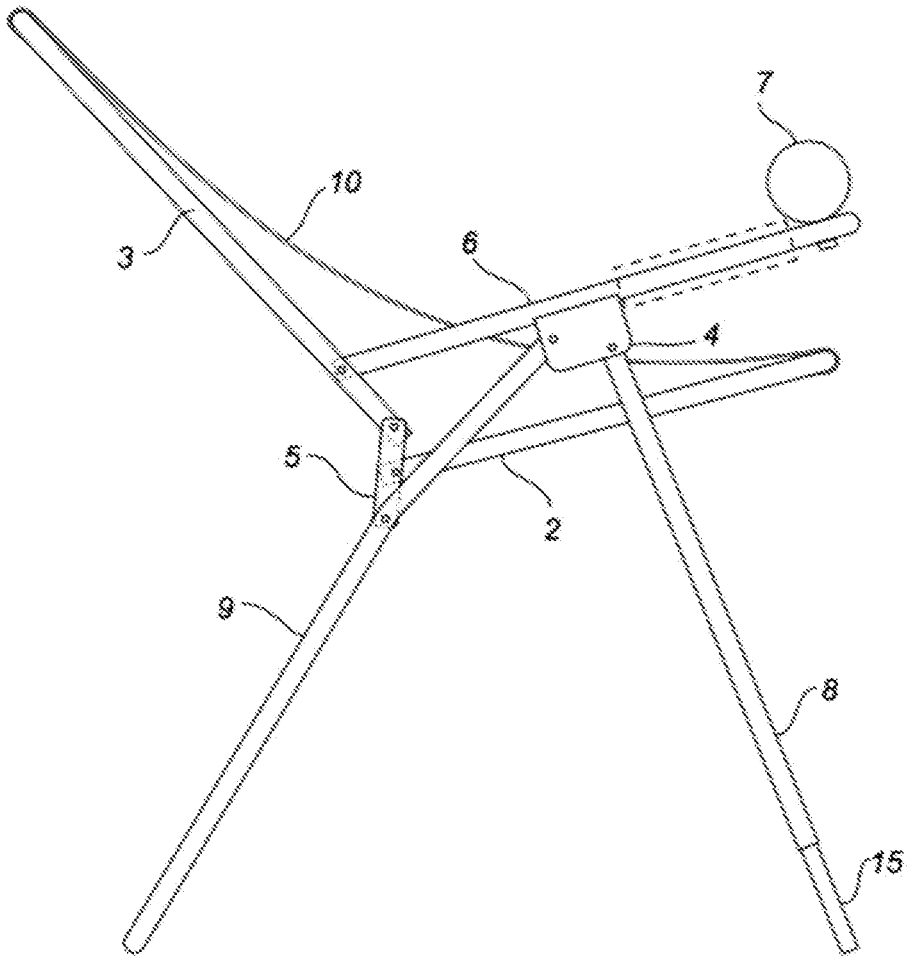
FIG. 8 is an exemplary embodiment of a profile view of a conjugal aid chair for supporting a human body during an intimate activity, according to one aspect of the current invention.

FIG. 8 shows a profile view of conjugal aid chair 100 focusing on the rotation points of first pivot plate 4 and second pivot plate 5. In one embodiment, first angle adjuster 15 can be raised or lowered vertically to a selected elevation, which provides the user with the ability to select the best height for the standing person of various heights. In another embodiment, plurality of appendage bolsters 7 is removable allowing a user to change their body angle during intimate activities.

Figure 9A:
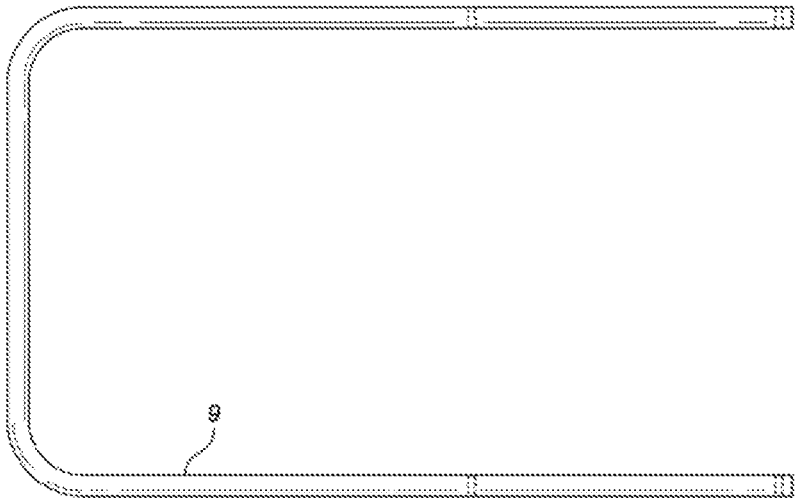
FIG. 9A is an exemplary embodiment of a top view of a back leg frame.

FIG. 9A shows one embodiment of top view of back leg frame 9 separate from other interacting elements.

Figure 9B:
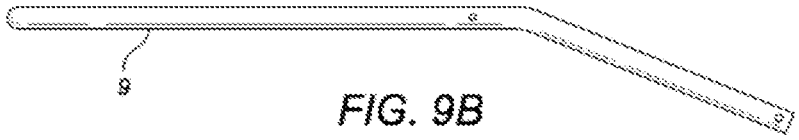
FIG. 9B is an exemplary embodiment of a profile view of a back leg frame with the appropriate bends.

FIG. 9B shows one embodiment of profile view of back leg frame 9 separate from other interacting elements.

Figure 10A:
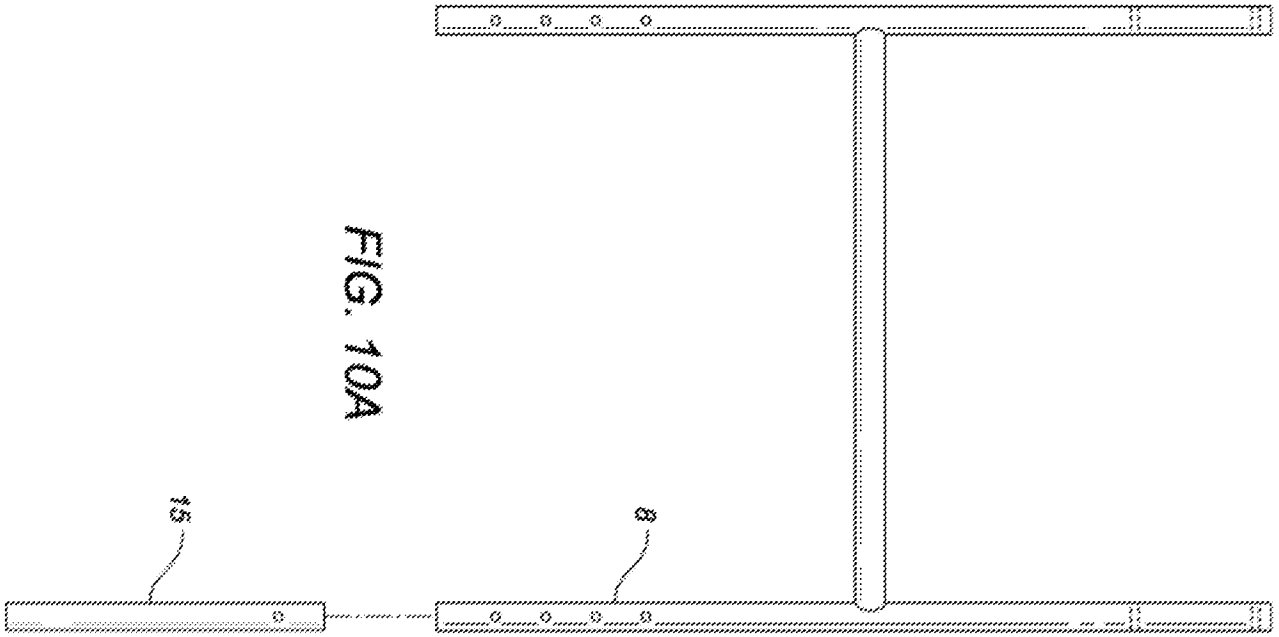
FIG. 10A is an exemplary embodiment of a front view of a front leg frame and an angle adjuster.

FIG. 10A shows one embodiment of front view of front leg frame 8 and first angle adjuster 15 separate from other interacting elements.

Figure 10B:
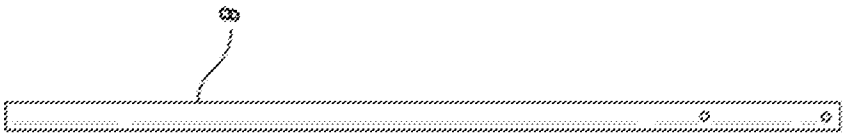
FIG. 10B is an exemplary embodiment of a profile view of a front leg frame.

FIG. 10B shows one embodiment of profile view of front leg frame 8 separate from other interacting elements.

Figure 11A:
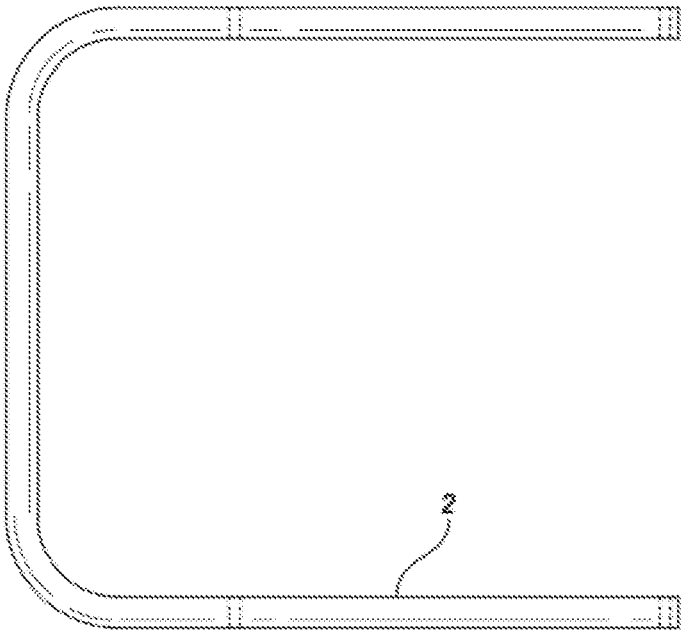
FIG. 11A is an exemplary embodiment of a top view of a seat frame.

FIG. 11A shows one embodiment of top view of seat frame 2 separate from other interacting elements.

Figure 11B:
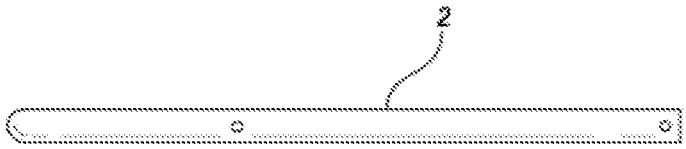
FIG. 11B is an exemplary embodiment of a profile view of a seat frame.

FIG. 11B shows one embodiment of profile view of seat frame 2 separate from other interacting elements.

Figure 12A:
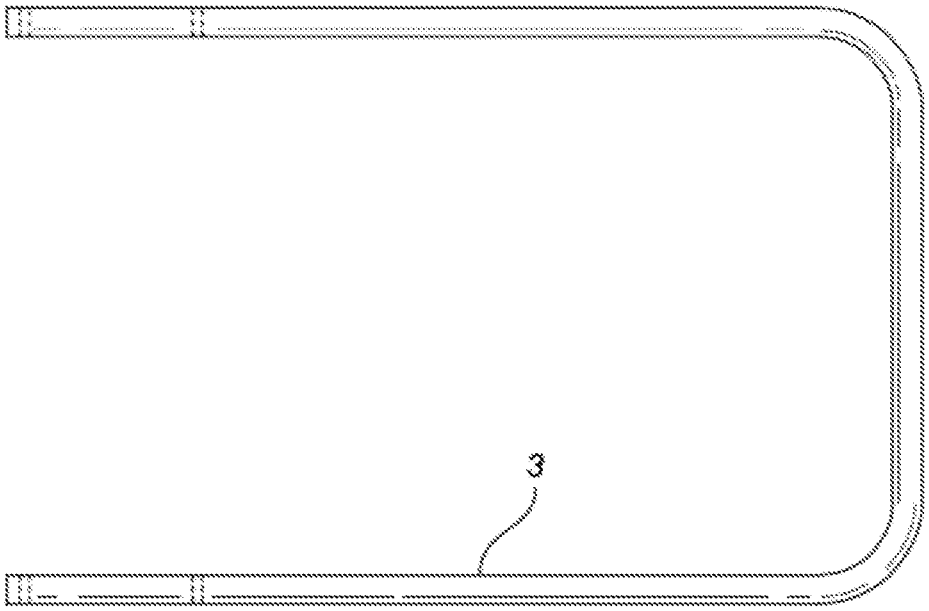
FIG. 12A is an exemplary embodiment of a top view of a back frame.

FIG. 12A shows one embodiment of top view of back frame 3 separate from other interacting elements.

Figure 12B:
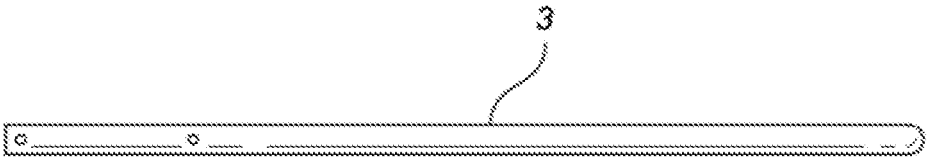
FIG. 12B is an exemplary embodiment of a profile view of back frame.

FIG. 12B shows one embodiment of profile view of back frame 3 separate from other interacting elements.

Referring back to FIG. 1 and FIG. 8, in an exemplary embodiment, conjugal aid chair 100 can be folded to a convenient configuration for storing purposes via adjusting first angle adjuster 15 to the shortest collapsible position into front leg frame 8. Accordingly, back leg frame 9 is then rotatably adjusted along rotation point on the bottom hole of second pivot plate 5 until parallel with seat frame 2. In another embodiment, front leg frame 8 is then pushed towards back leg frame 9 along its rotation point on first pivot plate 4 so that seat frame 2, back frame 3, back leg frame 9, and front leg frame 8 are all substantially parallel and in-line with each other. In yet another embodiment, first handle pair 13 is then pushed towards back frame 3 so as to be parallel with back frame 3. In one embodiment, second handle pair 14 is then pushed towards two arms 6 so as to be parallel with two arms 6. In another embodiment, plurality of appendage bolsters 7 are removed from two arms and stored separately.

All of the embodiments described herein are exemplary embodiments provided to enable persons skilled in the art to make or use the disclosure and not to limit the scope of the invention as defined by the claims.

The invention claimed is:

1. A folding, portable conjugal chair for use in positioning a human user for conjugal relations, the chair comprising:

a frame body having seat and back portions;

a user-support sling coupled to the seat and back portions of the frame body in a manner to receive the human user in a reclined position;

appendage bolsters coupled to the frame body and positioned to support legs of the human user in a spread-opened position; and multiple chair legs coupled to the frame body in a manner to:

support the frame body during use and allow angular adjustment of the frame body and the human user in the user-support sling; and effect folding of the chair for portability and storage.

2. The conjugal chair of claim 1, further comprising multiple pivot mechanisms coupling the frame body to the chair legs in a manner to allow the angular adjustment of the frame body and the user-support sling.

3. The conjugal chair of claim 2, where the pivot mechanisms also couple the seat portion of the frame body to the back portion of the frame body.

4. The conjugal chair of claim 2, where the pivot mechanisms also couple the chair legs to the frame body in a manner to allow folding the chair for storage.

5. The conjugal chair of claim 1, further comprising multiple chair arms coupled to the frame body in a manner to support arms of the human user during conjugal relations.

6. The conjugal chair of claim 5, where the chair arms couple the appendage bolsters to the frame body.

7. The conjugal chair of claim 1, further comprising one or more handles coupled to the frame body in a manner to provide support for a second human user during conjugal relations.

8. The conjugal chair of claim 7, wherein the one or more handles couple to the back portion of the frame body.

9. The conjugal chair of claim 1, wherein one or more of the appendage bolsters are height adjustable to allow positional adjustment of the human user.

10. The conjugal chair of claim 9, wherein the one or more appendage bolsters are height adjustable over a range of zero to about four inches.

11. The conjugal chair of claim 1, wherein one or more of the chair legs are height adjustable to allow positional adjustment of the human user.

12. The conjugal chair of claim 11, wherein the one or more chair legs are height adjustable over a range of zero to about seven inches.

13. The conjugal chair of claim 1, where at least one of the appendage bolsters is coupled to the frame body in a manner to allow adjustment of the position of the human user's legs.

14. The conjugal chair of claim 1, further comprising:

multiple chair arms coupled to the frame body in a manner to support arms of the human user during conjugal relations; and one or more handles coupled to the chair arms in a manner to provide support for a second human user during conjugal relations.

* * * * *